US006874280B2

(12) United States Patent
Dufour

(10) Patent No.: US 6,874,280 B2
(45) Date of Patent: Apr. 5, 2005

(54) COMPACT CABLE-TYPE WINDOW LIFTER

(75) Inventor: Fabien Dufour, Chateauneuf sur Loire (FR)

(73) Assignee: Meritor Light Vehicle Systems - France (FR)

( * ) Notice: Subject to any disclaimer, the term of this patent is extended or adjusted under 35 U.S.C. 154(b) by 28 days.

(21) Appl. No.: 10/300,463

(22) Filed: Nov. 20, 2002

(65) Prior Publication Data

US 2003/0101654 A1 Jun. 5, 2003

(30) Foreign Application Priority Data

Nov. 29, 2001 (FR) ..... 01 15443

(51) Int. Cl.[7] ..... E05F 11/48
(52) U.S. Cl. ..... 49/352
(58) Field of Search ..... 49/348, 349, 352, 49/502

(56) References Cited

U.S. PATENT DOCUMENTS 4,428,542 A 1/1984 Kobayashi et al.
4,910,917 A 3/1990 Brauer
5,375,375 A * 12/1994 Lee ..... 49/352
5,617,675 A * 4/1997 Kobrehel ..... 49/352
5,778,600 A * 7/1998 Chu ..... 49/352
6,115,966 A * 9/2000 Shibata ..... 49/352
2003/0009948 A1 * 1/2003 Nishikawa et al. ..... 49/502

FOREIGN PATENT DOCUMENTS

EP 0139269 2/1985

* cited by examiner

*Primary Examiner*—Jerry Redman
(74) *Attorney, Agent, or Firm*—Carlson, Gaskey & Olds

(57) ABSTRACT

A window lifter includes a window connecting element, a cable drive motor element offset from the path of travel of the window connecting element, a first and a second cable return which are superposed and arranged at one end of the path of travel of the window connecting element, and a third cable return arranged at another end of the path of travel of the window connecting element. A cable is secured to the window connecting element. The window lifter has, in particular, increased compactness.

13 Claims, 4 Drawing Sheets

COMPACT CABLE-TYPE WINDOW LIFTER

This application claims priority to French application No. 01 15 443 filed on Nov. 29, 2001.

BACKGROUND OF THE INVENTION

The invention relates to window lifters for motor vehicles and more particularly to motor vehicle window lifters with cable returns.

U.S. Pat. No. 4,910,917 discloses a cable type window lifter. This window lifter comprises two non-parallel rails guiding two respective sliders in a window-moving travel. Each slider is driven by a Bowden cable. Each slider has two parts. A first part is guided by the rail and a second part is fixed to the window. The two parts slide relative to one another in translation and in rotation. This device allows the relative position of the two parts to be adjusted to prevent the window from being braced against a window frame.

This device has disadvantages. It occupies a significant area projected onto the mid-plane of the window. This device also entails the use of two guide rails.

There is therefore a need for a window lifter that solves one or more of these drawbacks.

SUMMARY OF THE INVENTION

The subject of the invention is thus a window lifter comprising a window connecting element, a cable drive motor element, offset from the travel of the connecting element, a first and a second cable return which returns are arranged at one end of the travel of the connecting element and superposed, a third cable return arranged at another end of the travel of the connecting element, and a cable secured to the window connecting element.

According to an alternative form, the cable is guided in succession by the first return, the motor element, the second return and the third return.

According to yet another alternative form, of the first and second returns, one is a pulley.

According to another alternative form, the first and second returns are pulleys.

According to yet another alternative form, the first and second pulleys are mounted to rotate about the same axis.

Provision may alternatively be made for the pulley to have two grooves forming first and second returns respectively.

According to an alternative form, the two pulleys or grooves have different diameters.

According to another alternative form, the diameter of one pulley or groove is defined so that the cable between this pulley or groove and the third return remains parallel to the travel of the connecting element.

According to yet another alternative form, the diameter of the other pulley or groove is defined so that the cable between the other pulley or groove and the connecting element remains parallel to the travel of the connecting element.

Other features and advantages of the invention will become apparent from reading the description which follows of some embodiments of the invention, which is given by way of example with reference to the appended drawings which show:

DETAILED DESCRIPTION OF THE PREFERRED EMBODIMENT

The invention relates to a window lifter having a connecting element, a motor element offset from the travel of the motor element and two superposed returns arranged at one end of the travel.

In that which follows, two superposed returns are to be interpreted as being two returns which overlap at least in part, when considered in a direction normal to the plane of the return, and the planes of which are substantially parallel but separate. The plane of a return is defined by the plane which includes the cable parts entering and leaving a return.

Figure 1:
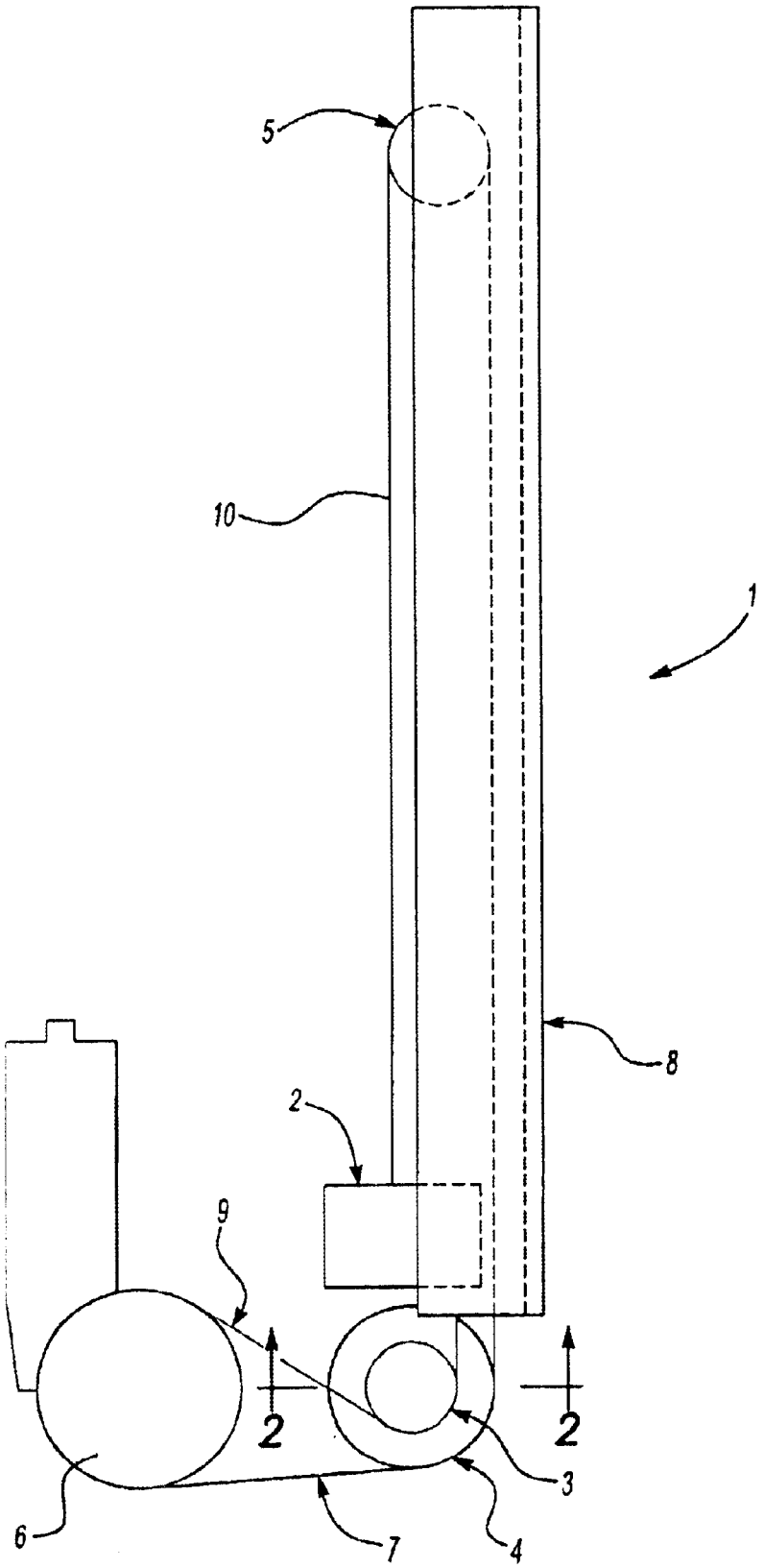
FIG. 1 is a schematic depiction of one example of a window lifter according to the invention.
Figure 2:
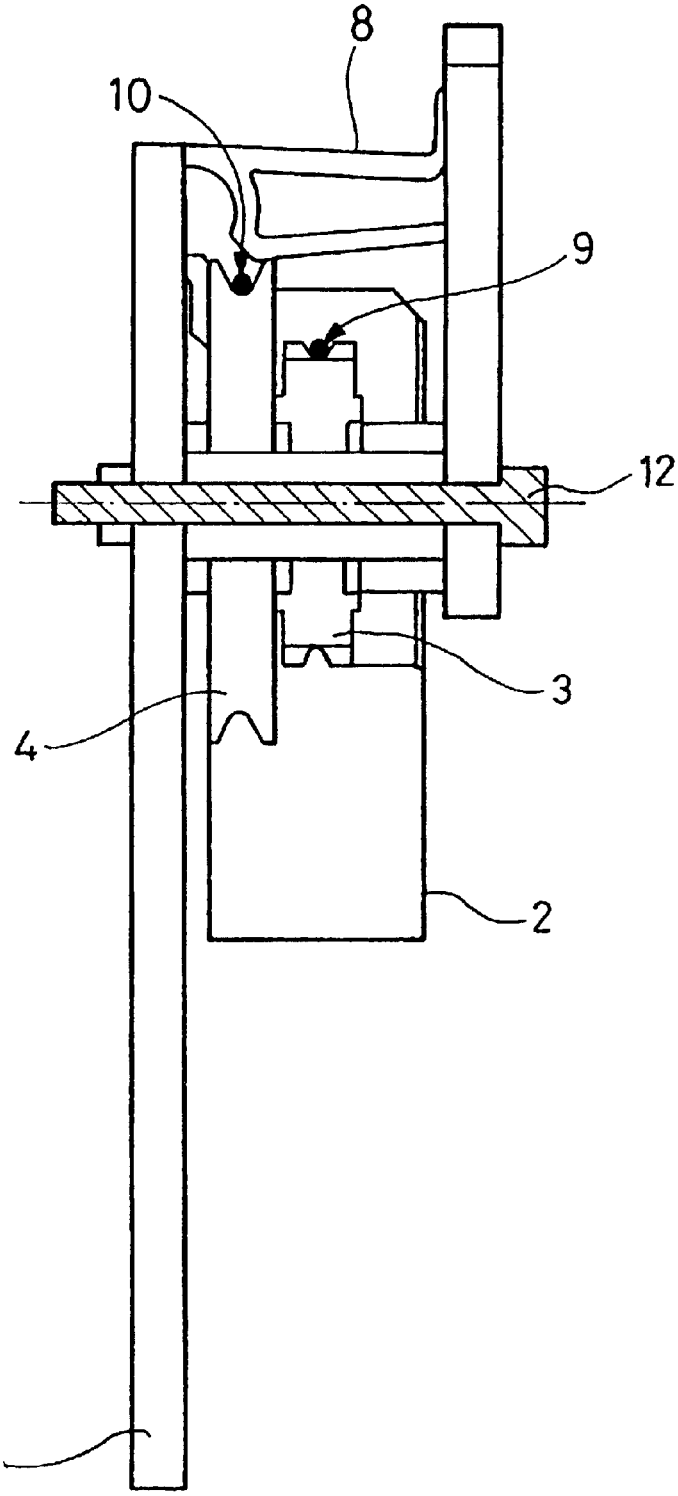
FIG. 2 is a view in cross section of the window lifter of FIG. 1 taken along line 2—2 of FIG. 1.
Figure 3:
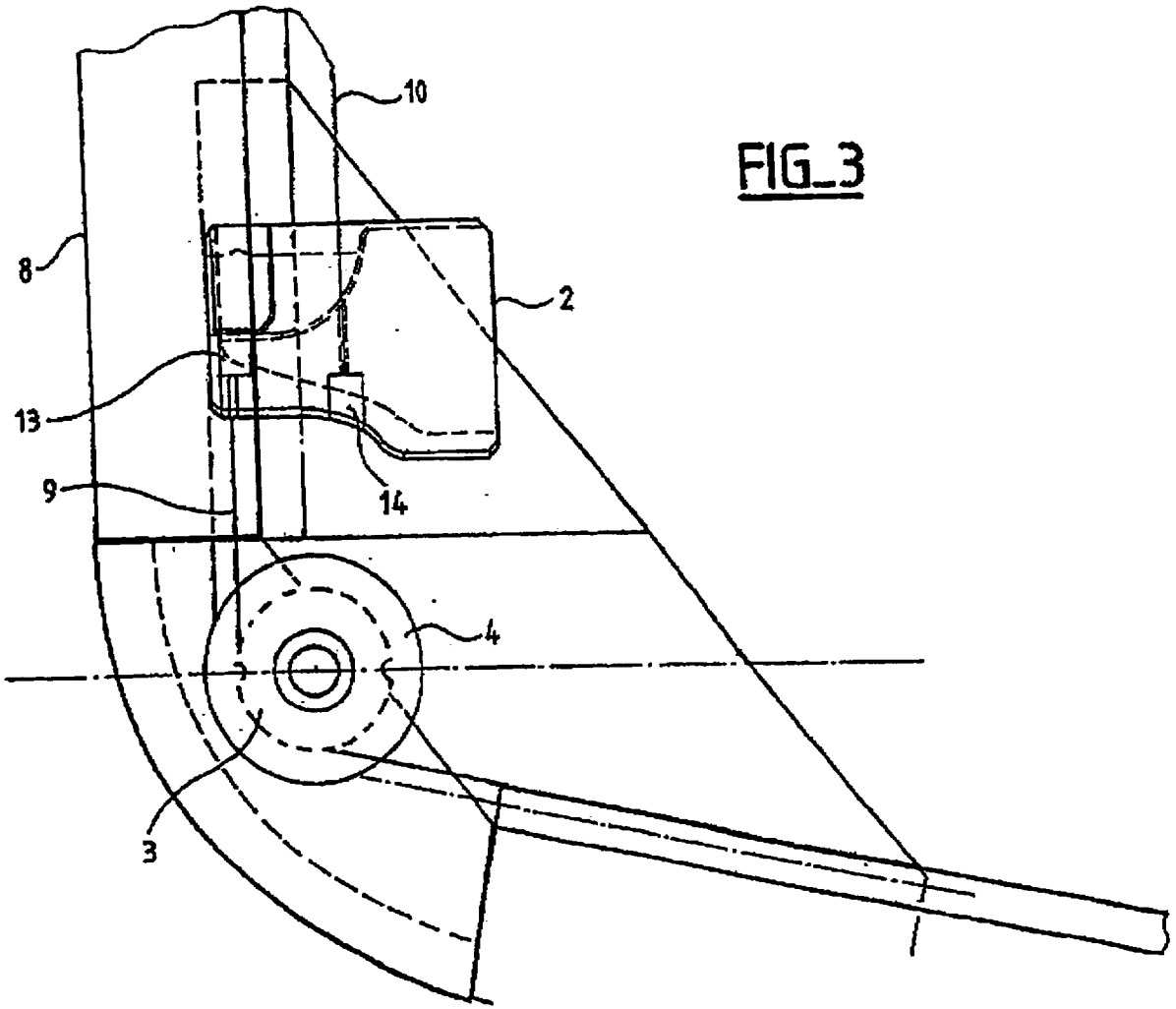
FIG. 3 is a rear view of a portion of the window lifter.
Figure 4:
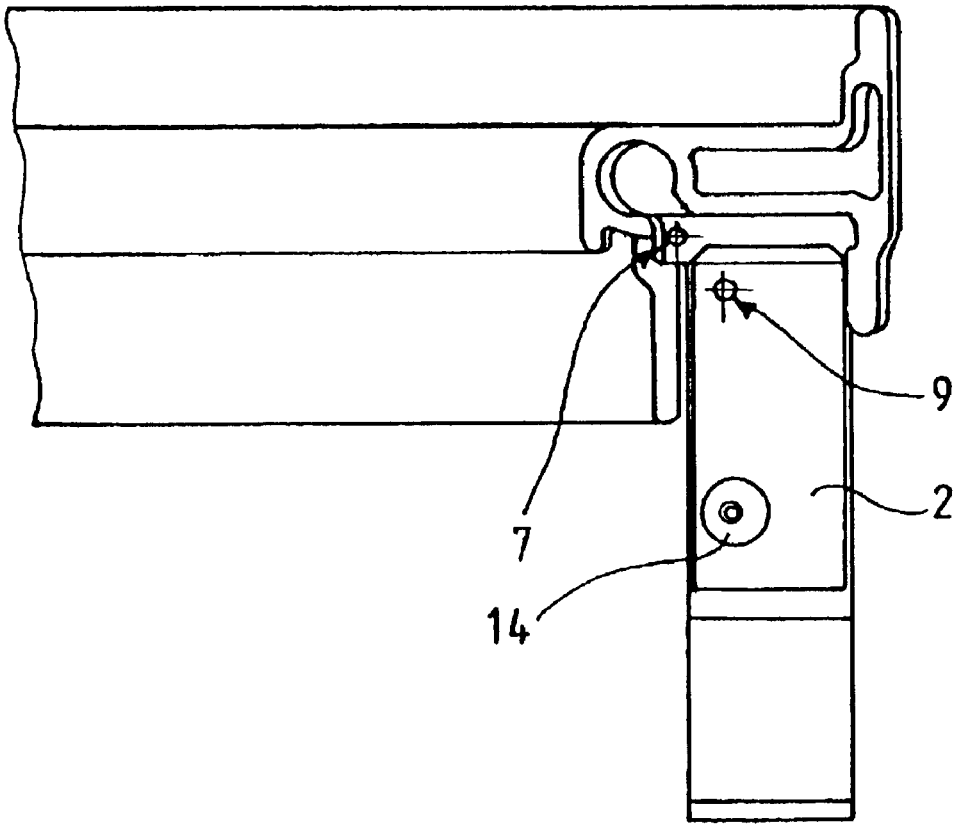
FIG. 4 is a top view of the window connecting element of the window lifter.

FIGS. 1 to 4 depict one example of a window lifter 1 according to the invention. The window lifter 1 includes a window connecting element 2. A window to be moved, depicted in dashed line in FIGS. 1 and 3, is secured to the window connecting element 2. The window connecting element 2 is mounted to slide with respect to a guide rail 8. A cable 7 has two ends 9 and 10 each secured to the window connecting element 2 by the lower part and by the upper part, respectively. The window lifter 1 has a return 5 arranged at one end of the travel of the window connecting element 2 and two superposed returns 3 and 4 arranged at the other end of the travel of the window connecting element 2. As shown in FIG. 1, the returns 3 and 4 are superposed in a direction perpendicular to a plane defined by the path of travel of the window connecting element 2. A motor element 6 driving the cable 7 is offset from the path of travel of the window connecting element 2. A cable-tensioning system, not depicted, may be fitted to keep the cable 7 taut.

The return 3 deflects the path of the end 9 of the cable 7, and the end 9 applies a downwards force on the window connecting element 2. The return 4 deflects the path of the end 10 of the cable 7, and the end 10 applies an upwards force on the window connecting element 2. The returns 3 and 4 are superposed. Thus, the space occupied by the window lifter 1 in the mean plane defined by the cable 7 is reduced. In addition, when the motor element 6 includes a winding drum having a helical groove, it may be particularly advantageous to use superposed returns 3 and 4. By arranging the superposed returns 3 and 4 opposite the cable parts leaving the groove, the cable parts leaving the groove can run with the smallest deflection of their path as far as the respective returns 3 and 4. The cable 7 is then less stressed in the direction perpendicular to the plane of the returns 3 and 4, reducing the friction of the cable 7 on the returns 3 and 4.

In the example depicted, the end 10 of the cable 7 is fixed to the window connecting element 2, then runs in succession over the return 5, over the return 4, through the motor element 6, over the return 3, and the end 9 of the cable 7 is fixed to the window connecting element 2. The three cable parts arranged in the path of the window connecting element 2, that is between the returns 5 and the returns 3 and 4, thus occupy a particularly compact volume, making it possible to free up space, for example, in a door in which the window lifter 1 may be mounted. In this arrangement, and because the returns 3 and 4 are superposed, the cable parts running between the motor element 6 and the returns 3 and 4 also occupy a particularly compact amount of space.

In an advantageous alternative form of the invention, at least one of the returns 3 or 4 is produced in the form of a pulley. By mounting such a pulley for example so that it can rotate with respect to a structural part 11 of the window lifter, friction between the pulley and the cable that it guides is reduced.

As depicted in FIG. 2, it is also possible to envisage using two returns 3 and 4 in the form of pulleys. It is then preferable to use a common axis for the pulleys. It is, for example, possible to envisage mounting the returns 3 and 4 about the same shaft 12 which guides their rotation. The structure and the mounting of the window lifter 1 are thus simplified. Although returns 3 and 4 with a common axis have been depicted, it is also possible to envisage pulleys with offset respective axes. It is, for example, possible to envisage mounting the returns 3 and 4 to rotate about respective shafts.

In the example depicted, the returns 3 and 4 have different diameters. The return 3 thus has a diameter smaller than the diameter of the return 4. Thus, the cable part running between the return 4 and the return 5 can run outside the volume swept by the window connecting element 2 in its travel. This then prevents rubbing between the cable 7 and the window connecting element 2. As shown in FIG. 1, the returns 3 and 4 are substantially circular.

In the example depicted, the guide rail 8 includes a guide slot for guiding the window connecting element 2. As can be seen in FIG. 1, the cable part between the returns 4 and 5 and the cable part between the return 5 and the window connecting element 2 remain contained in the volume of the slotted part of the guide rail 8. The cable parts are thus protected by the guide rail 8 and arranged inside a compact volume. This protection advantageously makes it possible to dispense with a sheath.

It is also possible to envisage using returns 3 and 4 including one mounted to rotate with respect to the structural part 11, while the other return is fixed. It is also possible to envisage a single two-grooved pulley to reduce the number of components in the window lifter 1. The pulley is then mounted to rotate with respect to the structure of the window lifter 1. The pulley will then turn in the same direction as a first part of the cable 7 that it guides and will turn in the opposite direction to another cable part that it guides. The pulley is preferably designed to rotate in the same direction as the cable part intended to exert an upwards force on the window connecting element 2.

It is also possible to superpose a return in the form of a pulley mounted so that it rotates with a return which is fixed with respect to the structure. It is then possible, as appropriate, to use an element of the rail as a cable return. The pulley is preferably used to guide the cable that exerts the upwards force on the window connecting element.

FIG. 3 depicts details of the window connecting element 2. The window connecting element 2 includes fixing elements 13 and 14 that fix the ends 9 and 10 of the cable 7, respectively, as further shown in FIG. 4. The distance between the fixing elements 13 and 14, projected onto a straight line perpendicular to the travel of the window connecting element 2 within a plane of a return, is approximately equal to the distance, in the same projection, between a point of contact of the return 3 with the cable 7 and a point of contact of the return 5 with the cable 7. Thus, the cable parts running respectively between the return 3 and the window connecting element 2 and between the return 5 and the window connecting element 2 remain parallel throughout the movement of the window slider 1. Thus cable deflection is reduced. Cable 7 wear and noise are thus reduced.

Although a guide rail 8 is employed in the example depicted, it is of course possible to envisage within the context of the invention for the window lifter to be free of a rail. It can then be envisaged for the connecting element 2 to be guided by appropriate tension in the cable parts running between the return 5 and the returns 3 and 4.

Furthermore, although just one window connecting element has been described in the window lifter presented, it is just as easy to envisage a second connecting element with a travel more or less parallel to that of the connecting element described. It is thus possible to envisage for another cable, driving the other connecting element, also to be coupled to the motor element 6.

Of course, the present invention is not restricted to the exemplary embodiments described and depicted but can be varied in numerous ways accessible to those skilled in the art. It is thus possible to envisage for the cable 7 to be split into several independent cables. It is possible to envisage coupling the independent cables, for example, at the motor element.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A window lifter comprising:

a window connecting element moveable along a travel path, said travel path including a first end and a second opposing end, said travel path defining a plane;

a cable drive motor element offset from said travel path of said window connecting element;

a first cable return and a second cable return which are both arranged at said first end of said travel path of said window connecting element, wherein said first cable return and said second cable return are at least partially superposed in a direction substantially perpendicular to said plane, wherein both of said first cable return and said second cable return is a pulley, wherein said first cable return has a first diameter and said second cable return has a second diameter, and said first diameter is different than said second diameter;

a third cable return arranged at said second opposing end of said travel path of said window connecting element; and a cable secured to said window connecting element.

2. The window lifter as recited in claim 1, wherein said cable is guided in succession by said first cable return, said cable drive motor element, said second cable return and said third cable return.

3. The window lifter as recited in claim 1, wherein said first cable return and said second cable return rotate about a common axis.

4. The window lifer as recited in claim 1, wherein a first portion of said cable is located between said third cable return and one of said first cable return and said second cable return, and said first portion of said cable is substantially parallel to said travel path of said window connecting element.

5. The window lifter as recited in claim 4, wherein a second portion of said cable is located between said window connecting clement and the other of said first cable return and said second cable return, and said second portion of said cable is substantially parallel to said travel path of said window connecting element.

6. The window lifter as recited in claim 1, wherein said first cable return and said second cable return are both rotatable about a common shaft.

7. A window lifter comprising:

a window connecting element moveable along a travel path, said travel path including a first end and a second opposing end, said travel path defining a plane;

a cable drive motor element offset from said travel path of said window connecting element;

a first cable return and a second cable return which are both arranged at said first end of said travel path of said window connecting element, wherein said first cable return and said second cable return are at least partially superposed in a direction substantially perpendicular to said plane;

a pulley having a first groove and a second groove, said first groove and said second groove defining said first cable return and said second cable return, respectively, wherein said first groove has a first diameter and said second groove has a second diameter, and said first diameter is different than said second diameter;

a third cable return arranged at said second opposing end of said travel path of said window connecting element; and a cable secured to said window connecting element.

8. The window lifter as recited in claim 7, wherein a first portion of said cable is located between said third cable return and one of said first groove and said second groove, and said first portion of said cable is substantially parallel to said travel path of said window connecting element.

9. The window lifter as recited in claim 8, wherein a second portion or said cable is located between said window connecting element and the other of said first groove and said second groove, and said second portion of said cable it substantially parallel to said travel path of said window connecting element.

10. A window lifter comprising:

a window connecting element moveable along a travel path, said travel path including a first end and a second opposing end, said travel path defining a plane;

a cable drive motor element offset from said travel path of said window connecting element;

a first cable return and a second cable return which are both arranged at said first end of said travel path of said window connecting element, wherein said first cable return and said second cable return are at least partially superposed in a direction substantially perpendicular to said plane, wherein said first cable return is rotatable and said second cable return is non-rotatable;

a third cable return arranged at said second opposing end of said travel path of said window connecting element; and a cable secured to said window connecting element.

11. The window lifter as recited in claim 10, wherein said first cable return and said second cable return are both substantially circular.

12. The window lifter as recited in claim 10, wherein said cable extends from said first cable return, through said cable drive motor element, and to said second cable return.

13. The window lifter as recited in claim 10, wherein a first portion of said cable extends from said window connecting element to said third cable return and a second portion of said cable extends from said third cable return to one of said first cable return and said second cable return, and said first portion of said cable is substantially parallel to said second portion of said cable.

* * * * *